US007550910B2

(12) United States Patent
Jansma

(10) Patent No.: US 7,550,910 B2
(45) Date of Patent: Jun. 23, 2009

(54) FLUORESCENT LAMP WITH BARRIER LAYER CONTAINING PIGMENT PARTICLES

(75) Inventor: Jon B Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 17 days.

(21) Appl. No.: 11/269,318

(22) Filed: Nov. 8, 2005

(65) Prior Publication Data

US 2007/0103050 A1 May 10, 2007

(51) Int. Cl.
*H01J 1/62* (2006.01)
*H01J 63/04* (2006.01)

(52) U.S. Cl. ..... 313/489; 313/484; 313/485

(58) Field of Classification Search ..... 313/484–489, 313/493, 627–643
See application file for complete search history.

(56) References Cited

U.S. PATENT DOCUMENTS

| | | | | | |
|---|---|---|---|---|---|
| 2,838,707 | A * | 6/1958 | Schwing et al. | ..... | 313/489 |
| 3,548,237 | A * | 12/1970 | Schreurs | ..... | 313/489 |
| 3,571,648 | A * | 3/1971 | Hanada et al. | ..... | 313/487 |
| 3,617,357 | A * | 11/1971 | Nagy | ..... | 428/34.4 |
| 4,379,981 | A * | 4/1983 | Rusch | ..... | 313/489 |
| 4,500,810 | A * | 2/1985 | Graff | ..... | 313/486 |
| 4,547,700 | A * | 10/1985 | Landry | ..... | 313/487 |
| 4,691,140 | A * | 9/1987 | Sakakibara et al. | ..... | 313/486 |
| 4,800,319 | A | 1/1989 | Van Kemenade | | |
| 4,916,359 | A * | 4/1990 | Jonsson | ..... | 313/489 |
| 4,924,141 | A * | 5/1990 | Taubner et al. | ..... | 313/488 |
| 5,008,789 | A * | 4/1991 | Arai et al. | ..... | 362/255 |
| 5,602,444 | A | 2/1997 | Jansma | | |
| 5,726,528 | A * | 3/1998 | Jansma et al. | ..... | 313/489 |
| 5,811,924 | A * | 9/1998 | Okumura et al. | ..... | 313/487 |
| 5,838,100 | A | 11/1998 | Jansma | | |
| 6,222,312 | B1 | 4/2001 | Ghosh | | |
| 6,400,097 | B1 * | 6/2002 | Jin et al. | ..... | 315/246 |
| 6,452,324 | B1 * | 9/2002 | Soules et al. | ..... | 313/486 |
| 6,528,938 | B1 | 3/2003 | Jansma | | |
| 6,531,814 | B1 * | 3/2003 | Jansma | ..... | 313/479 |
| 6,583,566 | B1 * | 6/2003 | Jin et al. | ..... | 313/637 |
| 6,683,407 | B2 * | 1/2004 | Lisitsyn et al. | ..... | 313/489 |
| 6,774,557 | B2 | 8/2004 | Jansma | | |
| 6,841,939 | B2 | 1/2005 | Scott et al. | | |

(Continued)

FOREIGN PATENT DOCUMENTS

GB 1482301 A 10/1977

(Continued)

OTHER PUBLICATIONS

US 5,650,691, 07/1997, Jansma (withdrawn)

*Primary Examiner*—Sikha Roy
*Assistant Examiner*—Jose M Diaz
(74) *Attorney, Agent, or Firm*—Pearne & Gordon LLP

(57) ABSTRACT

A mercury vapor discharge fluorescent lamp having a barrier layer which is 0.01 to 50 weight percent pigment particles, the presence of the pigment particles in the barrier layer increasing the CRI value of the lamp by at least 1 or 2 or 3 to preferably at least 90. The pigment particles are preferably inorganic and yellow. The color temperature of the lamp is preferably 2300-3800 K. The pigment particles help filter out mercury emissions at 405 and 436 nm.

16 Claims, 1 Drawing Sheet

U.S. PATENT DOCUMENTS

| | | | | |
|---|---|---|---|---|
| 6,867,536 | B2 * | 3/2005 | Srivastava et al. | 313/487 |
| 6,952,081 | B1 | 10/2005 | Jansma et al. | |
| 6,965,193 | B2 * | 11/2005 | Srivastava et al. | 313/486 |
| 7,229,572 | B2 * | 6/2007 | Hampden-Smith et al. | 252/301.4 R |
| 2002/0008462 | A1 | 1/2002 | Juestel et al. | |
| 2003/0015956 | A1 * | 1/2003 | Lisitsyn et al. | 313/489 |
| 2004/0061428 | A1 * | 4/2004 | Sigai et al. | 313/486 |
| 2004/0113537 | A1 * | 6/2004 | Srivastava et al. | 313/486 |
| 2004/0113538 | A1 * | 6/2004 | Srivastava et al. | 313/486 |
| 2004/0113539 | A1 * | 6/2004 | Soules et al. | 313/487 |
| 2004/0232820 | A1 | 11/2004 | Jansma | |
| 2005/0248276 | A1 * | 11/2005 | Nomura et al. | 313/635 |
| 2006/0017366 | A1 * | 1/2006 | Hendriks et al. | 313/489 |
| 2009/0081757 | A1 * | 3/2009 | Ekkundi et al. | 435/188 |
| 2009/0082554 | A1 * | 3/2009 | Dellinger et al. | 536/23.1 |
| 2009/0088501 | A1 * | 4/2009 | Qiu et al. | 524/100 |

FOREIGN PATENT DOCUMENTS

| | | | |
|---|---|---|---|
| JP | 2000323097 | A * | 11/2000 |

* cited by examiner

FLUORESCENT LAMP WITH BARRIER LAYER CONTAINING PIGMENT PARTICLES

FIELD OF THE INVENTION

The present invention relates generally to fluorescent lamps and more particularly to a fluorescent lamp having a barrier layer containing pigment particles.

DESCRIPTION OF RELATED ART

Fluorescent lamps and their operation are well known in the art. Fluorescent lamps utilize an electric discharge to excite mercury vapor to produce ultraviolet light, which causes a phosphor layer deposited on or over the inner surface of a glass envelope to fluoresce and emit visible light. In addition to ultraviolet light, the mercury discharge also produces narrow visible emissions at wavelengths of 405, 436, 546 and 578 nm. To achieve good color rendition, particularly at lower color temperatures, it is beneficial to attenuate, such as via filtering, some or most of the 405 and 436 nm emissions.

For high color rendition lamps, one solution to this problem has been to add light absorbing pigment particles to the phosphor layer in order to absorb or filter out the 405 and 436 nm mercury discharge lines. Other solutions to this problem include coating a discrete layer of pigment particles between the phosphor layer and the glass, using a tinted glass envelope, and external filter coatings or filter sleeves over the outer surface of the glass envelope. However, these solutions have drawbacks that include increased cost, lower performance, decreased process control and added manufacturing steps. Accordingly, the present invention is directed to an improved barrier layer that includes pigment particles to filter out undesirable visible emissions from the mercury discharge.

SUMMARY OF THE INVENTION

A mercury vapor discharge fluorescent lamp comprising a light-transmissive envelope having an inner surface, means for providing a discharge, a discharge-sustaining fill sealed inside said envelope, a phosphor layer inside the envelope and adjacent the inner surface of the envelope, and a barrier layer between the envelope and the phosphor layer. The barrier layer is 0.01 to 50 weight percent pigment particles and the barrier layer has sufficient pigment particles such that the presence of the pigment particles in the barrier layer increases the CRI value of the lamp by at least 1.

DETAILED DESCRIPTION OF THE PREFERRED EMBODIMENTS OF THE INVENTION

Figure 1:
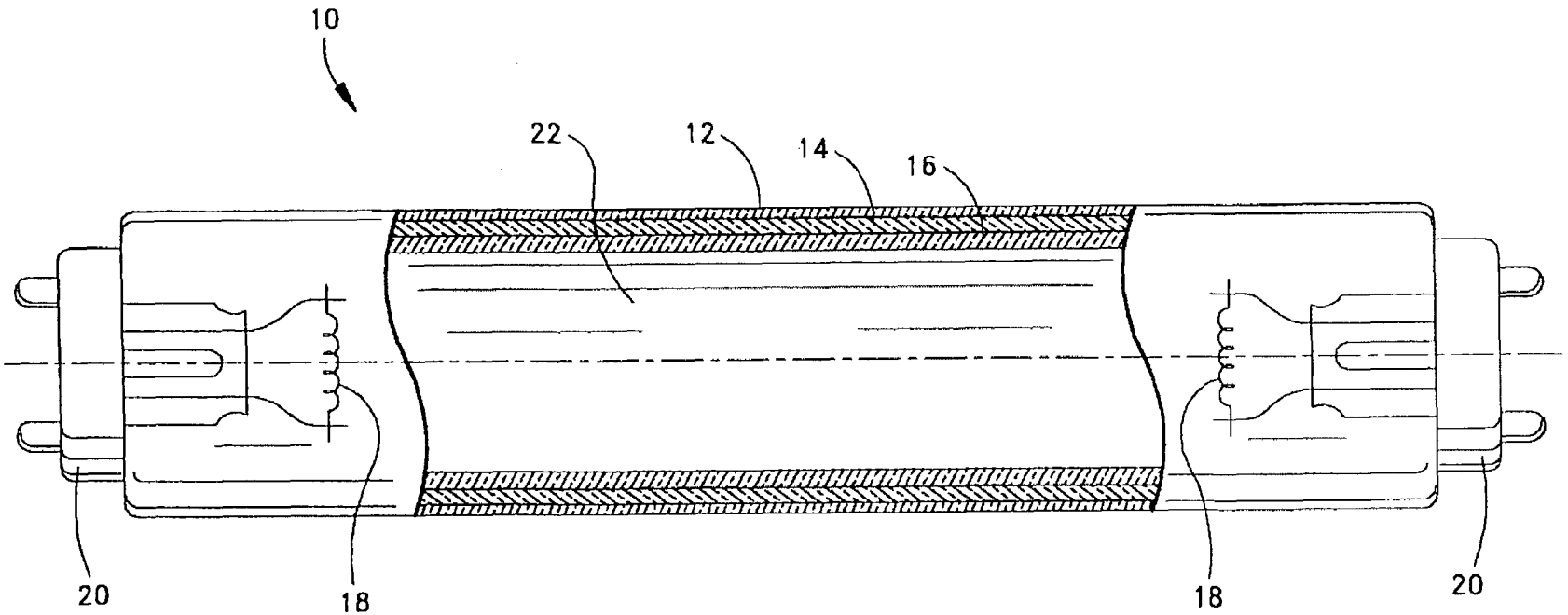
FIG. 1 shows diagrammatically, and partially in section, a fluorescent lamp according to the present invention.

In the description that follows, when a preferred range, such as 5 to 25 (or 5-25), is given, this means preferably at least 5 and, separately and independently, preferably not more than 25.

As used herein, a "fluorescent lamp" is any mercury vapor discharge fluorescent lamp as known in the art, including fluorescent lamps having electrodes, and electrodeless fluorescent lamps where the means for providing a discharge include a radio transmitter adapted to excite mercury vapor atoms via transmission of an electromagnetic signal. The contents of U.S. Pat. Nos. 5,602,444, 6,952,081 and 6,774,557 are incorporated herein by reference in their entirety. Also as used herein, a "T8 lamp" is a fluorescent lamp as known in the art, preferably linear, preferably nominally 48 inches in length, and having a nominal outer diameter of 1 inch (eight times ⅛ inch, which is where the "8" in "T8" comes from). Less preferably, the T8 fluorescent lamp can be nominally 2, 3, 6 or 8 feet long, less preferably some other length. Other fluorescent lamps capable of utilizing the present invention include, but are not limited to, T12, T10 and T5 lamps, preferably linear, and compact, 2D, spiral, electrodeless lamps, etc.

With reference to FIG. 1, there is shown a representative low pressure mercury vapor discharge fluorescent lamp 10, which is generally well known in the art. The fluorescent lamp 10 has a light-transmissive glass tube or envelope 12 that has a circular cross section. Though the lamp in FIG. 1 is linear, the invention may be used in lamps of any shape and any cross section. The inner surface of the envelope 12 is provided with an ultraviolet reflecting barrier layer 14 according to the present invention. The inner surface of the barrier layer 14 is provided with a phosphor layer 16, the barrier layer 14 being between the envelope 12 and the phosphor layer 16. Phosphor layer 16 is as known in the art and preferably has a coating weight of 1-5 mg/cm$^2$. Phosphor layer 16 is preferably a rare earth phosphor layer, such as a rare earth triphosphor layer, but it may also be a halophosphate phosphor layer or any other phosphor layer or layers as known in the art that absorbs ultraviolet light.

Optionally, other layers may be provided inside the envelope 12; for example, adjacent to or between the layers 14 and 16, such as for example multiple phosphor layers may be provided, for example a halophosphate phosphor layer may be provided between the barrier layer and a rare earth triphosphor layer.

The fluorescent lamp 10 is hermetically sealed by bases 20 attached at both ends and electrodes or electrode structures 18 (to provide an arc discharge) are respectively mounted on the bases 20. The pair of spaced electrodes is a means for providing a discharge. A discharge-sustaining fill 22 is provided inside the sealed glass envelope, the fill being typically an inert gas such as argon or a mixture of argon and other noble gases such as krypton at a low pressure in combination with a small quantity of mercury to provide the low vapor pressure manner of lamp operation.

The invented barrier layer is preferably utilized in a low pressure mercury vapor discharge lamp, but may less preferably be used in a high pressure mercury vapor discharge lamp. The invented barrier layer may be used in fluorescent lamps having electrodes as is known in the art, as well as in electrodeless fluorescent lamps as are known in the art, where the means for providing a discharge is a structure which provides high frequency electromagnetic energy or radiation.

The barrier layer 14 of the present invention improves the color rendering index (CRI) and the full or continuous or natural spectrum output of lamps described herein by absorbing or filtering the visible emissions at wavelengths of 405 and 436 nm (i.e. discharge lines) produced by the mercury discharge. As a result of filtering these discharge lines, the barrier layer 14 also may filter a portion of the visible light emitted by the phosphor layer 16. Preferably, the invented barrier layer 14 filters visible light at shorter wavelengths (such as violet and blue) more than visible light at longer wavelengths. More preferably, the discharge lines at 405 and 436 nm are filtered more than the mercury discharge lines at 546 and 578 nm.

At lower color temperatures, the mercury discharge lines at 405 and 436 nm stand out from the visible spectrum more than the mercury lines at 546 and 578 nm. In the invented barrier layer it is desirable to provide the pigment concentration, type(s) or combinations thereof to more effectively filter the 405 and 436 nm discharge lines; the invention is particularly useful in lamps with lower color temperatures, preferably color temperatures of 2000-5000 K, preferably 2300-3800 K, preferably 2500-3500 K, preferably 2800-3300 K or 3000-3200 K or 3100-3300 K or about 2900 K or about 3200 K. For example, a 3200 K full spectrum lamp containing the invented barrier layer 14 would more closely match the incandescent halogen lamp visible spectral output than would a lamp having a conventional barrier layer.

The invented barrier layer 14 can also be used to partially filter mercury discharge lines or portions of the visible spectrum. In applications where portions of the visible spectrum require partial filtering or partial filtering of individual mercury discharge lines is desired, the pigment concentration and/or type in the barrier layer 14 can be adjusted accordingly. For example, a lightly pigmented barrier layer can be used to partially filter mercury discharge lines of 405 and 436 nm, whereas a heavily pigmented barrier layer can be used to substantially filter the 405 and 436 nm discharge lines from the lumen output of a lamp.

Use of the barrier layer 14 of the present invention permits more accuracy and control of pigment weight to be used in a lamp. Pigment particles are added to and thoroughly mixed with the barrier layer particles before the barrier layer is applied to the inner surface of the glass envelope 12 as known in the art. As such, the combined amount of barrier layer particles and pigment particles can be easily adjusted to achieve the desired weight ratio of pigment to barrier layer particles.

The invented barrier layer contains barrier layer particles dispersed with pigment particles. The barrier layer particles used in the invention are those which are known in the art for barrier layers and include alumina, yttria, yttria-coated alumina, silica, and other inert metal oxides as known in the art, and combinations thereof. The barrier layer particles preferably are colloidal and do not absorb visible light to any appreciable or significant or substantial or material extent and are preferably alumina. The preferred alumina particles preferably have a deagglomerated median particle diameter or size of 10-6000, more preferably 50-2500, more preferably 100-1200, more preferably 180-800, more preferably 240-700, more preferably 400-600, more preferably about 500, nm, or about 0.5 microns, and a specific surface area of 0.3-800, more preferably 0.8-300, more preferably 2-120, more preferably 4-70, more preferably 6-50, more preferably 7-40, $m^2/g$. If barrier layer particles other than alumina are used, they typically have the same or similar diameters.

The invented barrier layer in the finished lamp, including barrier layer particles and pigment particles, preferably has a coating weight of 0.05-3, more preferably 0.1-1, more preferably 0.3-1, $mg/cm^2$, or a coating weight which is conventional for known unpigmented barrier layers as known in the art. The invented barrier layer is preferably 0.2 to 4, preferably 1-3, microns thick.

The pigment particles to be used in the invented barrier layer include those known in the fluorescent lamp art and those which are known in the art to make colored lamps or tinted glass envelopes or external filter coatings or pigmented phosphor layers for fluorescent lamps and those that are stable within a fluorescent lamp. Pigment particles as used in this invention differ from barrier layer particles because pigment particles preferentially absorb and/or preferentially reflect a certain portion of the visible spectrum, while barrier layer particles uniformly and nonpreferentially reflect and/or absorb the entire visible spectrum. For example, a common pigment particle will preferentially absorb in the blue and preferentially reflect in the yellow, while a barrier layer particle will treat the entire visible spectrum the same as far as absorption and reflection are concerned. Pigment particles which can be used in the invention are those which are known in the art and include those identified in pigment handbooks, such as "The Pigment Handbook" by Peter A. Lewis, John Wiley & Sons, New York, 3 Volumes, 1988, ISBN: 0-47182833-5. Preferably the pigment particles in the invention do not fluoresce as a phosphor would and do not act like phosphors. The invented barrier layer should be free or substantially free from the presence of phosphors.

Preferred pigment particles for use in the invention are nickel antimony titanate, chrome antimony titanate, praseodymium doped zirconates, cadmium-based yellow pigments, lead-based yellow pigments, and mixtures thereof. Inorganic pigments and yellow pigments are preferred. Preferred pigments preferentially absorb light at 405 and 436 nm and in the violet and blue areas of the visible spectrum. Less preferred are green and magenta pigment particles. Although lead-based and cadmium-based pigments can be used, they are less preferred because they may be considered harmful to the environment. The pigment particles in the barrier layer preferably have a deagglomerated median particle diameter or size of 0.1-100, more preferably 0.3-30, more preferably 1-10 and more preferably 2-5, microns.

Preferably, the barrier layer 14 contains 0.01-50, preferably 0.1-45, preferably 1-40, preferably 2-30 or 2-25 or 5-25 or 5-20, preferably 3-20 or 10-20, preferably 5-15 or 5-10, perferably at least 5, 6, 7, 8, 9, 10, 12, 14 or 16, weight percent pigment particles, with the balance being barrier layer particles as known in the art, said barrier layer particles being preferably alumina particles.

The filtering effectiveness of the pigment particles added to the barrier layer 14 is relatively independent of the barrier layer thickness. As such, it is not preferred to alter the thickness of the barrier layer 14 of the present invention from that of an unpigmented barrier layer generally used. However, the barrier layer 14 thickness can be adjusted to accommodate higher pigment weight percents to ensure the pigment is uniformly dispersed within the layer 14.

It is desirable to utilize pigment particles and barrier layer particles of sizes that ensure dense packing of the particles. A densely packed barrier layer provides improved filtering of visible mercury discharge lines, reduced mercury reaction with the glass envelope and greater reflection of ultraviolet light into the phosphor layer.

The invented barrier layer is preferably used in lamps having a CRI of 90-100 or 92-98, or at least 90, 91, 92, 93, 94, 95 or 96. Lamps according to the invention preferably have sufficient pigment particles added to or incorporated into the barrier layer to increase the CRI value of the lamp by at least 1, 2, 3, 4, 5, 6, 7, 8 or 9, that is, the barrier layer has sufficient pigment particles such that the presence of the pigment particles in the barrier layer increases the CRI value of the lamp by at least 1, 2, 3, 4, 5, 6, 7, 8 or 9. Preferably, the presence of the pigment particles added to or in the barrier layer reduces the lumens per watt (LPW) of the lamp by not more than 0.5, 1, 2, 3, 4, 5, 6, 7, 8, 9 or 10 LPW. The invention is preferably used in highly loaded lamps, i.e., those with high current loading, such as lamps that are adapted to operate at 0.6 to 1 amp.

In order to promote a further understanding of the invention, the following examples are provided. These examples are shown by way of illustration and not limitation.

EXAMPLES

Twelve lamps were constructed, each one being a T8 Cinema lamp, HF at 40 kHz and 600 ma. Each lamp had a barrier layer between the glass envelope and the phosphor layer. The lamps were the same except for the barrier layers. The first six lamps (lamps 1-6) had barrier layers comprising alumina particles. The last six lamps (lamps 7-12) had barrier layers comprising 16 weight percent nickel antimony titanate yellow pigment and 84 weight percent alumina particles. The barrier layers all had the same coating weight, which was about 0.8 mg/cm$^2$. The pigment particles were blended and well dispersed with the barrier layer particles and were substantially uniformly distributed throughout the barrier layer. The barrier layers were applied in a conventional manner.

The lumens per watt (LPW) and color rendering index (CRI) of the twelve lamps was measured after 100 hours of operation. The results of lamps 1-6 and lamps 7-12 were averaged together and are as follows.

TABLE 1

| Test Cell of Lamps | Barrier Layer (wt. %) | Lumens per Watt (LPW) | Color Rendering Index (CRI) |
|---|---|---|---|
| Lamps 1-6 | 100% alumina | 55.9 | 85.4 |
| Lamps 7-12 | 16% nickel antimony titanate yellow, 84% alumina | 53.1 | 90 |

As can be seen above, the CRI value was significantly improved with minimal loss in LPW when the pigment particles were added to the barrier layer. These results were surprising and unexpected.

Another test was conducted which contrasted the spectral power distribution of lamps 1-6 with that of lamps 7-12. A spectral scan of each lamp was taken, wherein the scans for lamps 1-6 were averaged together and the scans for lamps 7-12 were averaged together. From the results, it was seen that the spectral power distribution for lamps 7-12 showed a strong absorption of visible light in the wavelength range of 400 to 530 nm. Particularly, strong absorption of mercury discharge lines at 405 and 436 nm was observed in lamps 7-12 as contrasted with lamps 1-6, which contained conventional alumina barrier layers. Further, at wavelengths of 600 to 760 nm, it was observed that lamps 7-12 showed weak or minimal absorption of visible light as contrasted with lamps 1-6. As such, a lamp with the invented barrier layer produces a spectral power distribution more like tungsten light at longer wavelengths, particularly at wavelengths of 600 to 760 nm. These results were also surprising and unexpected.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge fluorescent lamp comprising a light-transmissive envelope having an inner surface, means for providing a discharge, a discharge-sustaining fill sealed inside said envelope, a phosphor layer inside the envelope and adjacent the inner surface of the envelope, and a barrier layer between the envelope and the phosphor layer, said barrier layer comprising alumina particles and pigment particles, said pigment particles being greater than 0.01 and less than 25 weight percent of said barrier layer, said barrier layer being substantially free of a phosphor, and said barrier layer having sufficient pigment particles such that the presence of the pigment particles in the barrier layer increases the CRI value of the lamp by at least 1.

2. The lamp of claim 1, said barrier layer having sufficient pigment particles such that the presence of the pigment particles in the barrier layer increases the CRI value of the lamp by at least 3.

3. The lamp of claim 1, said barrier layer having sufficient pigment particles such that the presence of the pigment particles in the barrier layer increases the CRI value of the lamp by at least 5.

4. The lamp of claim 1, said barrier layer having sufficient pigment particles such that the presence of the pigment particles in the barrier layer increases the CRI value of the lamp by at least 7.

5. The lamp of claim 2, said lamp being a low pressure fluorescent lamp.

6. The lamp of claim 1, said lamp having a color temperature of 2300-3800 K.

7. The lamp of claim 1, said lamp having a CRI of at least 90.

8. The lamp of claim 1, said barrier layer being 50-99.99 weight percent alumina.

9. The lamp of claim 1, said barrier layer being 2-25 weight percent pigment particles.

10. The lamp of claim 1, said barrier layer being 5-20 weight percent pigment particles.

11. The lamp of claim 1, said pigment particles being selected from the group consisting of nickel antimony titanate, chrome antimony titanate, praseodymium doped zirconates, cadmium-based yellow pigments, lead-based yellow pigments, and mixtures thereof.

12. The lamp of claim 1, said pigment particles being inorganic pigment particles.

13. The lamp of claim 1, said pigment particles being yellow pigment particles.

14. The lamp of claim 1, said lamp having a CRI of at least 92.

15. The lamp of claim 1, wherein the presence of the pigment particles in the barrier layer reduces the lumens per watt of the lamp by not more than 4.

16. The lamp of claim 1, said lamp being adapted to operate at 0.6 to 1 amp.

* * * * *